United States Patent [19]

Erickson

[11] 4,103,749

[45] Aug. 1, 1978

[54] DOWNHOLE CLEANER ASSEMBLY FOR PETROLEUM WELLS

[75] Inventor: John W. Erickson, Huntington Beach, Calif.

[73] Assignee: Kobe, Inc., Huntington Park, Calif.

[21] Appl. No.: 764,824

[22] Filed: Feb. 2, 1977

Related U.S. Application Data

[63] Continuation-in-part of Ser. No. 746,408, Dec. 1, 1976.

[51] Int. Cl.[2] ..... E21B 3/12

[52] U.S. Cl. ..... 175/70; 175/107; 415/502

[58] Field of Search ..... 175/70, 57, 92, 93, 175/95, 96, 100, 107; 166/105.1, 105.3; 308/187, 8.2; 415/116, 144, 502

[56] References Cited

U.S. PATENT DOCUMENTS

| | | | |
|---|---|---|---|
| 2,353,534 | 7/1944 | Yost | 175/107 |
| 2,628,819 | 2/1953 | Parsons | 175/107 |
| 2,735,646 | 2/1956 | Wagner | 175/107 |
| 2,880,970 | 4/1959 | Swart | 175/372 |
| 2,908,534 | 10/1959 | Rielsch | 175/107 |
| 3,112,800 | 12/1963 | Bobo | 175/67 |
| 3,400,819 | 9/1968 | Burdyn | 175/66 |
| 3,433,312 | 3/1969 | Burdyn et al. | 175/66 |
| 3,894,818 | 7/1975 | Tschirky | 308/187 |
| 3,912,426 | 10/1975 | Tschirky | 175/107 |

*Primary Examiner*—James A. Leppink
*Attorney, Agent, or Firm*—Christie, Parker & Hale

[57] ABSTRACT

A centrifugal cleaner powered by a turbine are both downhole in a housing at the end of a drill string. A branch of a drilling mud stream is cleaned of solid matter by the centrifugal cleaner. A branch of the clean fluid drives the turbine of the centrifugal cleaner. A second branch of the clean fluid does useful work at the downhole location, such as erosive drilling of bore hole rock. Turbine exhaust, cleaner exhaust and drilling mud combine and flow into the rock erosion zone to clear it of chips formed by the drilling. Fluid from this zone passes up the annulus between the bore hole and the drill string.

22 Claims, 4 Drawing Figures

Fig. 2
Fig. 1
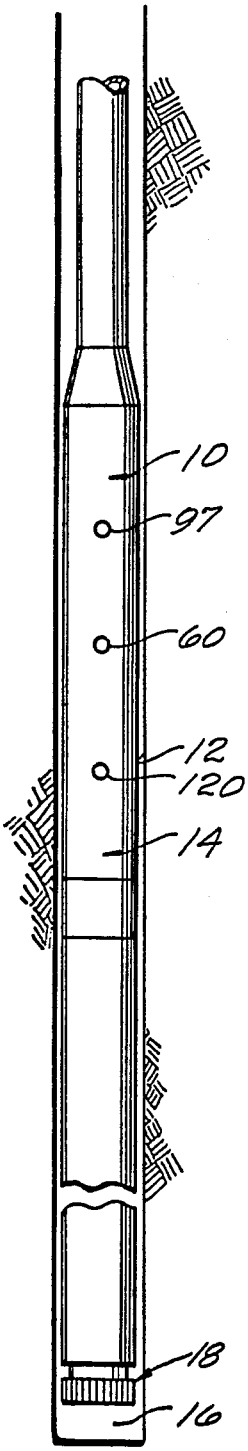
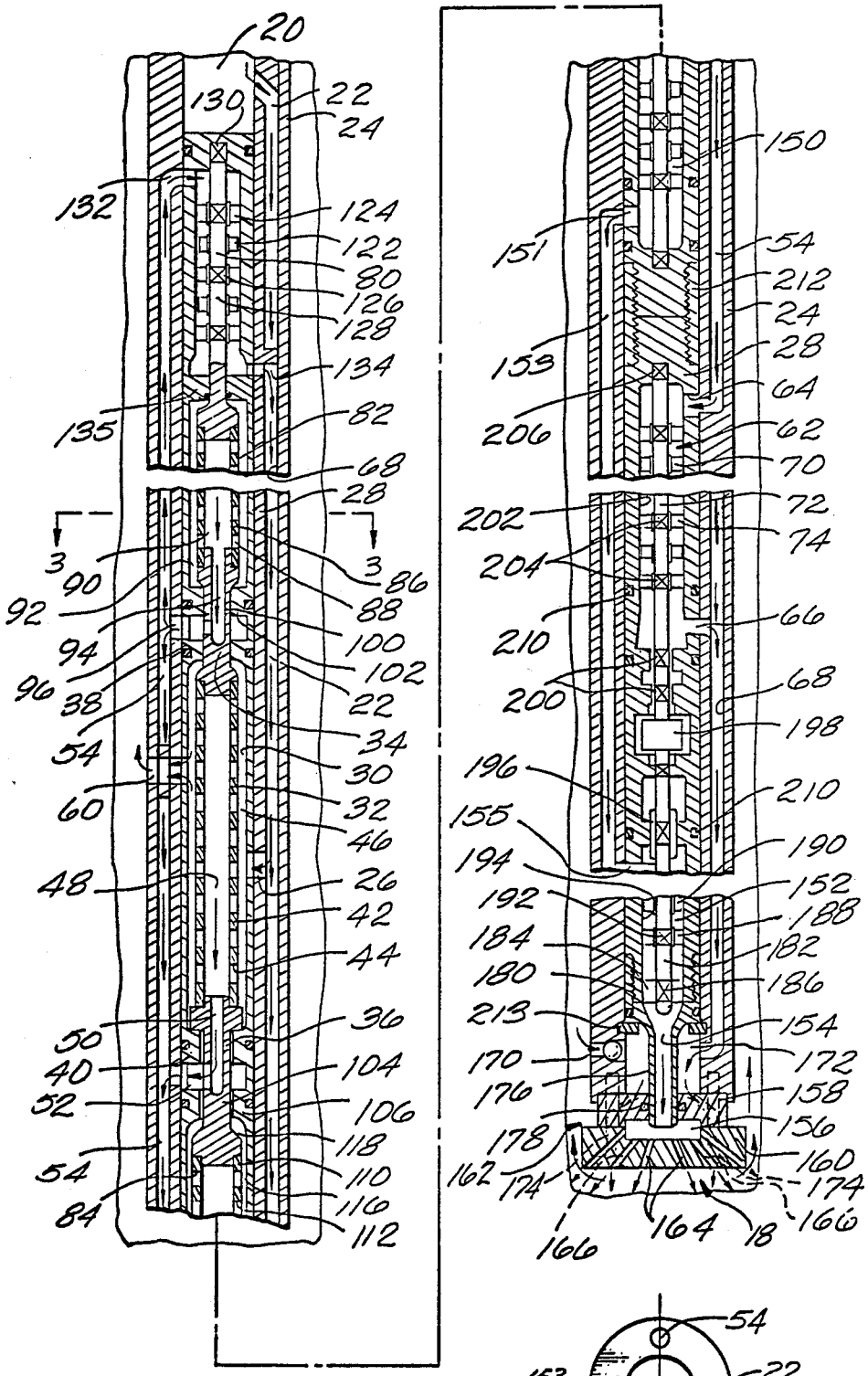
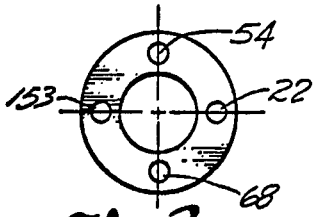
Fig. 3

DOWNHOLE CLEANER ASSEMBLY FOR PETROLEUM WELLS

CROSS REFERENCE TO RELATED APPLICATION

This application is a continuation-in-part application of application Ser. No. 746,408, filed Dec. 1, 1976.

BACKGROUND OF THE INVENTION

The present invention relates to cleaners for separating solids from fluids and, in particular, to centrifugal cleaners powered by a turbine which in turn receives its energy from the fluid to be cleaned and such cleaners and turbines used downhole in petroleum wells.

It is known that rock can be drilled by fluid at extremely high pressure. The fluid erodes the rock away. These fluid drills operate at pressures of the order of 5,000 Kg/cm$^2$ with a jet velocity of the order of 200 to 1,000 m/sec.

Proposed techniques for exploiting this technique of rock penetration in petroleum well formation have recognized and sought to use the high total head of drilling mud available in the zone where rock erosion is to take place. The head can represent several thousands of meters of dense drilling mud. These techniques have also recognized the use of drilling mud to clear out rock chips formed during rock erosion.

U.S. Pat. No. 3,112,800 to Bobo describes a downhole drilling technique. This patent describes a fluid-operated motor and pump near the bottom of a well. The pump provides high pressure fluid discharged as a jet to erode rock in the bore hole. The pump described in the Bobo patent is a reciprocating pump of the piston type.

Downhole turbines have also been used in drilling. Thus a power turbine has been used to drive a drill bit. An example of this is U.S. Pat. No. 2,908,534 to Rietsch.

Drilling mud is a dense fluid used to seal formation fluids in the ground and prevent them from blowing out the well. The fluid also transports drilling detritus out of the well. Drilling mud contains solids. It is known that these solids inhibit the effectiveness of erosive drilling. Drilling mud solids can also erode machinery parts such as turbo-machinery. Therefore, to use drilling mud as a working or a power fluid for downhole equipment requires that the solids of the mud be removed.

SUMMARY OF THE INVENTION

The present invention provides downhole cleaner means for petroleum wells. The cleaner separates solids from drilling mud and presents a clean stream to do useful work, for example, to erosively drill the formation in which a drill string is used. The cleaner means is received in an elongated housing that is adapted for receipt in the bore hole of the petroleum well at the base of a drill string. Means deliver drilling mud to the interior of the housing. Passage means in the housing divide the drilling mud stream into a first stream for supplying the cleaner and a second stream for delivery to a drilling zone at the base of the bore hole. Drive means in the housing drives the cleaner means. Passage means exhaust the stream of drilling mud containing separated solids from the housing into the annulus between the housing and the bore hole wall.

In one form of the invention the cleaner is centrifugal and is driven by a downhole turbine. The power fluid of the turbine is drilling mud. A drilling mud stream is branched with one branch supplying the cleaner. The cleaner separates solids from the liquid to produce a cleansed stream. The cleansed stream is branched with one branch being the power fluid for a turbine which drives the cleaner. The other cleansed stream branch does the useful work. The exhaust from the turbine preferably re-combines with the drilling mud as do the solids separated by the cleaner. A casing for the petroleum wells receives the cleaner means. Means, such as a conduit, feed drilling mud through the casing and into the cleaner. When the useful work is the drilling or bore hole rock, nozzle means to direct cleansed fluid against the rock is provided.

The present invention also contemplates introducing drilling mud into the well bore of a petroleum well being drilled. Downhole in the well bore a branch stream of the drilling mud is centrifugally cleaned by a centrifugal cleaner. By the cleaning, solids are taken from the stream and a cleansed stream results. This cleansed stream is then employed to do useful work. Preferably some of this work is in driving a turbine which drives the centrifugal separator. An example of additional work is erosive drilling of the formation in which the well bore occurs. Exhaust from the turbine and a stream of solids from the cleaner preferably feed back into the drilling mud stream.

A specific form of the present invention contemplates a downhole centrifugal cleaner having radial ports in an axially extending rotor. The cleaner is driven by a cleaner drive turbine located downhole with the cleaner and axially of the cleaner. Passage means direct drilling mud for passages radially inward of the rotor of the cleaner. Clean fluid is taken off axially of the cleaner and forms the feed for the cleaner drive turbine. A pressure difference across the wall of the cleaner rotor toward the axis of the rotor passes fluid radially inward through the rotor wall. Solid material suspended in the fluid has a density greater than the fluid. Centrifugal force on the solid material results in a pressure differential acting on the solid material in a direction opposite the fluid, radially outward from the rotor. The solid material accumulates outside the rotor. This type of centrifuge is described in U.S. Pat. No. 3,400,819 to Burdyn and 3,433,312 to Burdyn and Nelson. A branch of the clean fluid output of the cleaner is the power fluid for the cleaner turbine. The turbine lies axially of the cleaner. The exhaust from the turbine is manifolded for discharge into a zone of rock erosion, in the vicinity of a nozzle, to augment drilling mud in cleaning chips out of the zone and transporting them up the annulus to outside of the well. A dirty fluid stream containing the solids separated by the cleaner discharges into the annulus. A second branch of the cleaner output stream provides cleansed fluid for doing useful work. This fluid can be intensified for erosion drilling as by pumps and turbines powered by drilling mud.

The present invention provides a downhole cleaner for cleansing drilling mud of solids and providing a stream containing comparatively small amounts of solids. This cleansed stream can be used to do useful work as in erosively drilling rock of the well bore. Drilling mud as the fluid medium means no auxiliary conduits for power or working fluids. Another use of the clean fluid is in a downhole Mayno pump used as a motor.

These and other features, aspects and advantages of the present invention will become more apparent from the following description, appended claims and drawings.

BRIEF DESCRIPTION OF THE FIGURES

FIG. 1 illustrates the cleaner and turbine assembly of the invention with pressure intensifiers for use in jet rock drilling, as it appears in a bore hole;

FIG. 2 is an elevational view, foreshortened in places, and in half-section, illustrating the cleaner and drive turbine assembly of the present invention with concomitant pressure intensifier pumps and turbines for jet rock drilling;

FIG. 3 is a view taken at an axial location 3—3 of FIG. 2 to show fluid manifolding.

DESCRIPTION OF THE PREFERRED EMBODIMENT

Figure 4:
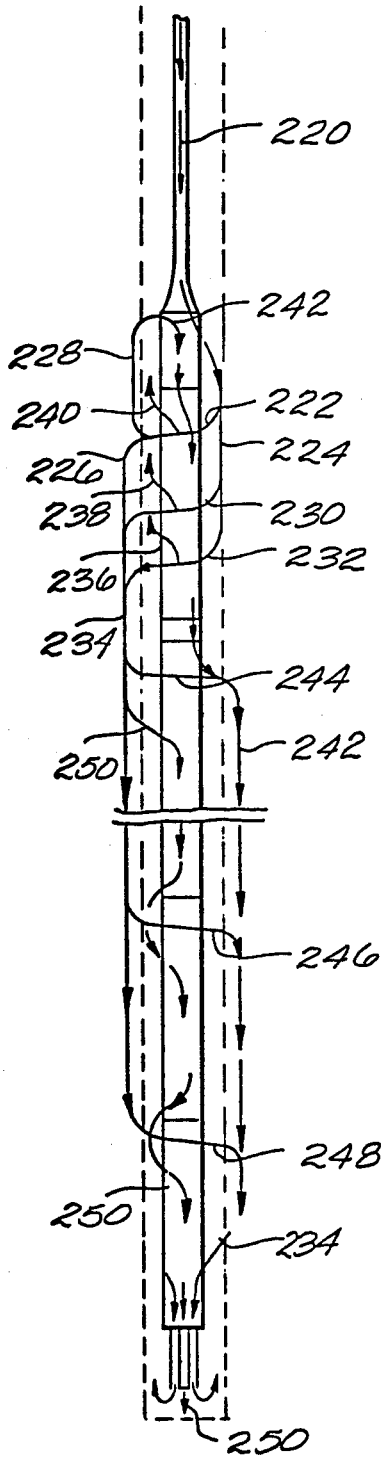
FIG. 4 is a view similar to FIG. 1 illustrating the flow of fluid in the cleaner, turbine and intensifier assembly.

The cleaner and turbine of the present invention are downhole apparatus which utilize drilling mud as their power fluid. The cleaner separates solids out of a branch stream of the drilling mud to produce a cleansed stream. The cleansed stream drives the cleaner drive turbine and does useful work. In the embodiment of the invention specifically illustrated, the useful work is in intensifying the pressure of a cleansed stream and eroding rock in a bore hole.

With reference to FIG. 1, a housing of a drill string 10 is at the bottom of a bore hole 12. A cleaner and drive turbine with intensifier assembly 14 of the present invention is the lower end of the drill string. The intensifier includes turbines staged in parallel and rotary pumps staged in series. The power fluid driving the turbines is cleansed drilling mud supplied from the surface. This fluid is also the working fluid of the pumps. The mud has a substantial head at typical bore hole bottom locations. The cleansed fluid for both the pumps and the turbines is an output of the cleaner of the invention and has a low solids content relative to the drilling mud feed to the cleaner. The intensifier turbines drive the pumps, and the pumps increase the head of a working fluid used to erode rock of the walls of the bore hole. Each rotary pump progressively increases the pressure of fluid until there is sufficient pressure for the rock erosion process of drilling. At this time the last stage pump exits high pressure fluid into a chamber upstream of power nozzles and the fluid passes through the nozzles as jet sat extremely high velocity and pressure to erode bore hole material in an erosion zone 16. The erosion zone is the volume in the bore hole and bore hole defining walls which are effectively eroded by the jets of fluid. The increase in head of the fluid in the pump stages is at the expense of the fluid used in driving the turbines. The nozzle assembly is shown at 18 at the very bottom end of the intensifier assembly.

In the specific embodiment illustrated there are five stages of intensification with each stage having a turbine and a pump. The exhaust from the turbines goes into the erosion zone to flush and carry chips and bore hole wall detritus away from the erosion zone. Drilling mud that has bypassed the turbines and pumps and the fluid from the nozzles combine with turbine exhaust for this flushing and transport.

The invention provides turbine power fluid and the pump working fluid as drilling mud cleaned of solid materials so that the blades of these turbo-machines are not eroded. Clean fluid is also the erosive fluid, for it has been determined that such fluid erodes faster than dirty fluid. A cleaner turbine powers centrifugal cleaners, with the power fluid of the cleaner turbine itself being drilling mud cleansed of solid material by the centrifugal cleaner.

With reference to FIG. 2, an axial conduit or passage 20 within the drill string provides the passage for drilling mud. A longitudinally extending passage 22 extends along the outside of the cleaner, drive turbine and intensifier assembly in a sleeve 24 and generally parallel to the axis of the assembly to supply drilling mud to the cleaner and to supply mud for flushing and transporting eroded bore hole material. In FIG. 2 the intensifier assembly has been rotated at intervals of 90° to show additional fluid passages, and so the entire longitudinal extent of passage 22 is not explicitly illustrated. Drilling mud in passage 22 passes radially inward through ports 26 in the walls of sleeve 24 and a casing 28 into an axial chamber 30. A centrifuge rotor 32 in the chamber mounts in the casing for rotation about the axis of the cleaner, turbine and intensifier assembly. Specifically, the centrifuge rotor has journals at 34 and 36 at its longitudinal ends that mount for rotation about the axis in journal bearings 38 and 40 of casing 28. The centrifuge rotor has a longitudinally extending wall 42 with a plurality of radial ports 44 extending through the wall between an annulus 46 outside the wall and a cavity 48 within the centrifuge rotor and coaxial with the intensifier assembly. An axial passage 50 extends out the bottom of the centrifuge rotor cavity and meets a radial drilling 52 that extends outwardly into a longitudinally extending, power fluid passage 54. Passage 54 supplies the power fluid for various turbines and also supplies the working fluid for the pumps.

The centrifugal action of centrifuge rotor 32 on drilling mud is described in U.S. Pat. Nos. 3,400,819 to Burdyn and 3,433,312 to Burdyn and Nelson. In general, fluid is urged radially towards the axis of the rotating centrifugal rotor by a pressure gradient. Centrifugal force on the fluid imparted by the centrifugal rotor opposes this gradient. The gradient, however, dominates and is sufficient to force the fluid through the perforations in the wall of the centrifugal rotor. Heavier solid material, however, is forced outside of the cylinder because centrifugal force on it is greater than the opposing force caused by the pressure gradient. This causes separation of solid and liquid and results in a cleaned fluid effluent exiting along the axis of the centrifugal rotor.

As seen in the middle of the left-hand side of FIG. 2, fluid with entrained solids leaves annulus 46 through a port 60 in the wall of casing 28 and sleeve 24 and enters well bore 12.

The clean effluent drives all the turbines and is plumbed to these turbines in parallel. Power fluid passage 54 from the discharge of the cleaner supplies the power fluid to the intakes to the turbines. As seen in the top middle of the right-hand side of FIG. 2, a turbine 62 receives power fluid from passage 54 through a radial port 64 formed in sleeve 24 and casing 28. The exhaust of this turbine exits radially through a port 66 and into a passage 68 for its use in flushing and transporting drilling waste from the erosion zone. Passage 68 extends longitudinally of the intensifier assembly in sleeve 24. Port 66 extends radially between passage 68 and the exhaust side of turbine 62 through sleeve 24 and casing 28. The turbine itself has blades 70 circularly arrayed about the axis of a turbine shaft 72, which itself lies on the axis of the intensifier assembly. These blades alternate between circularly arrayed stator flow guide blades 74 on casing 28. There are several turbines, say six. Each of the turbines, as well as each of the pumps, is axial flow, multiple stage.

There may be several stages of cleaning. Three are illustrated in the Figures. Thus a turbine 80 at the upper end of the assembly and in the left-hand view of FIG. 2 drives centrifuge rotors 82, 32 and 84. These centrifuges are plumbed in parallel so that drilling mud supply to them is supplied at the same pressure, and the discharges from them are at the same pressure. The feed, cleansing action, and discharge of each centrifugal rotor is functionally equivalent to the corresponding functions of centrifuge rotor 32. Dirty fluid from the cleaners, with separated solid material, joins drilling mud with bore hole wall material and both go up to the well head in the annulus between the drill string and the bore hole. At the surface the dirty fluid is processed to get rid of drilling waste and recycled.

Centrifuge rotor 82 has a wall 86 with ports 88 through it. The wall separates a central cavity 90 from an outer annulus 92. Cleaned fluid gathered in cavity 90 passes axially through axial passage 94 and radially out a discharge port 96 in the wall of the casing and sleeve into passage 54. Dirty fluid from centrifuge rotor 82 exits from the drill string at a port 97. Centrifuge rotor 82 has a journal 100 in journal bearing 102 of casing 28. Journal 100 and journal 34 of centrifuge rotor 32 are integral and part of a common connecting shaft between the centrifuge rotors. Similarly, a journal 104 of centrifuge rotor 84 journals in a journal bearing 106 of casing 28. Journals 104 and 36 are on a common shaft between joining centrifugal rotors.

Centrifugal rotor 84 has a wall 110 with ports 112 separating an axial cavity 114 from an annulus 116, all within a common chamber 118. The dirty fluid from centrifugal rotor 84 discharges out port 120 (FIG. 1).

Turbine 80 drives all three centrifugal rotors. The turbine has circularly arrayed, multistage blades 122 driven by clean fluid from passage 54. Stator guide blades 124 orient this power fluid for blades 122. Bearings 126 between turbine shaft 128 and stator blades retain the shaft radially. A thrust bearing 130 between the shaft and casing 28 transfers axial forces from the shaft to the casing. An inlet port 132 through sleeve 24 and casing 28 admits power fluid from passage 54 to the turbine. An exit port 134 through the casing and sleeve discharges power fluid exhaust from the turbine into passage 68. A radial wall 135 of the casing seals off the turbine from the pumps it drives.

The fluid cleaned in the cleaner stages also supplies the working fluid of the various pump stages.

Thus the fluid from the cleaners passes through passage 54 into the first stage pump inlet and its pressure is raised, and it discharges out radial ports into a lengthwise passage to the next or second stage pump. The exhaust of the first stage pump becomes the intake fluid to the second stage pump. This serial progression of fluid flow and pumped or working fluid head increase continues through the last pump stage. The next to the last and last pump stages are expressly shown at 150 and 152 and will be described in detail subsequently. The discharge of pump stage 150 passes through a radial port 151 in the casing and sleeve into passage 153. The working fluid in passage 153 enters last stage pump 152 through radial port 155 in the casing and sleeve. Pump stage 152 of the pumps exhausts into an axial passage 154, which empties into a disc-shaped cavity 156 sandwiched between two carbide plates 158 and 160 of a nozzle assembly 162. Nozzles 164 are oriented at various angles from the axis of the intensifier assembly so that the fluid they discharge impinges against the walls of the bore hole over a substantial area. The pressure at discharge can be on the order of 50,000 p.s.i.

The nozzle assembly, including the carbide plates, fasten on the end of the drill string by any convenient means, for example, screws 166. As stated previously, turbine exhaust and additional drilling mud carry away chips and other formation material formed as products of erosion during the drilling process. This waste is carried up the annulus between the bore hole and the drill string. In the normal course, turbine exhaust reaches an annulus 172 by passage 68 exiting into it. Turbine exhaust will then flow out of annulus 172 and into the erosion zone through passages 174, shown in phantom, in the carbide plates.

A check valve 170 in the base of the intensifier assembly allows reverse flowing power fluid to enter annulus 172 and force the intensifier assembly within the sleeve up the drill string for renewal. This is done in a manner similar to the free pump described in U.S. Pat. No. 2,338,903 to Coberly. The turbines, pumps and cleaners together with their casing are removable as a unit. The sleeve stays behind.

The pump of the last intensifier stage has a nose 176 which defines exit passage 154. An "O" ring 178 on upper carbide plate 158 seals the interfaces between the nose and the plate. The nose threads onto the base of casing 28 at 180. Common turbine and pump shaft 72 mounts for rotation in a spider 184. A bearing 186 between the spider and the shaft takes axial and radial loads. The spider has circularly arrayed and spaced-apart struts to transfer radial loads of shaft 182 to casing 28. Longitudinal passages between the struts pass pumped fluid.

Pump stage 152 has alternate circularly arrayed stator blades 188 and impeller blades 190 in a standard fashion. Journal bearings 192 between shaft 182 and the stator blades take radial loads. The pump impeller blades, stator blades and shaft are all in a chamber 194 within casing 28.

A balance piston 196 between chamber 194 of the pump and the turbine side of this intensifier stage has opposing areas to reduce the axial load on a thrust bearing 198 carried by shaft 72. The upper area of the piston sees turbine exhaust pressure and the lower area sees pump inlet pressure, which is higher. The bearing takes what axial load is not balanced and transmits the load from the shaft to casing 28. Journals 200 between the shaft and the casing transmit radial loads.

Last stage turbine 62 has its axially staggered stator and turbine blades 74 and 70 in a chamber 202 of casing 28. Journals 204 between the stator blades and shaft 182 take radial forces. A thrust bearing 206 between casing 28 and shaft 72 takes axial loads acting upwardly. "O" rings 210 occupy periodic longitudinal stations along the interface between the casing and the sleeve to prevent leakage along the interface.

Casing 28 forms of several longitudinally aligned and attached sections. The sections attach together at thread joints of male threaded plugs and female threaded couplers as shown at 212. The casing is held in place in sleeve 24 by a key 213 abutting the bottom of the casing and received in a groove in the wall of the sleeve. The sleeve may be formed in longitudinal sections and have longitudinal drillings for the fluid passages.

The construction of the last intensifier stage repeats itself with the other intensifier stages.

FIG. 3 shows the true circular orientation of the fluid passages in sleeve 24. Turbine exhaust passage 22, turbine inlet passage 54, cleaner inlet passage 68, and interpump passage 153 show there.

The plumbing of the intensifier assembly is shown to best effect in FIG. 4. The various streams are renumbered to avoid confusion with structure. A drilling mud stream 220 flows vertically in the drill string. It branches into branch streams 222 and 224 for parallel cleaning in the three centrifugal cleaners. Stream 222 is cleaned and then branches at 226 and 228. Clean stream 228 drives the turbine for the cleaners. Stream 224 branches at 230 and 232. Streams 230 and 232 are the fluid streams for the remaining two cleaners. The cleansed fluids from the cleaners unite in a stream 234, which is the power fluid for the various intensifier turbines. Additionally, this fluid forms the working fluid of the pumps for each stage of intensification. Exhaust streams 236, 238 and 240 from the cleaner stages empty into the annulus between the drill string and the bore hole. An exhaust stream 242 comes from the cleaner turbine.

Stream 234 from the cleaners branches to form the parallel feed streams to the intensifier turbines, three of such streams being shown at 244, 246 and 248. A fourth branch stream 250 from stream 234 forms the intensifier pumps' stream. This stream feeds the pumps in series. The exhaust from the intensifier turbines combines in stream 242, which empties into the erosion zone for chip flushing and transport from the zone.

The present invention has been described with reference to a preferred embodiment. The spirit and scope of the appended claims should not, however, necessarily be limited to the description.

What is claimed is:

1. A downhole cleaner assembly for a petroleum well comprising:

(a) an elongated housing adapted for receipt in a bore hole of the petroleum well at the base of a drill string;

(b) means for delivering drilling mud to the interior of the housing;

(c) passage means in the housing dividing the drilling mud into a first fluid stream and a second fluid stream, the second stream being delivered to a drilling zone at the base of the bore hole;

(d) cleaner means in the housing for at least partly removing solids from the first stream of the drilling mud and forming a cleansed liquid stream and an exhaust liquid stream containing solids from the drilling mud;

(e) drive means in the housing to drive the cleaner means;

(f) passage means to discharge the exhaust liquid stream containing solids from the drilling mud into an annulus between the housing and the wall of the bore hole to combine with drilling mud there that passed from the drilling zone; and (g) means for doing useful work with the stream of cleansed liquid in the bore hole.

2. The downhole cleaner assembly claimed in claim 1 wherein the cleaner means comprises at least one centrifugal cleaner means.

3. The downhole cleaner assembly claimed in claim 2 wherein the centrifugal cleaner means has centrifugal rotor means with passages through a wall thereof and an axis of rotation, the centrifugal rotor wall extending along the axis of rotation of the rotor, chamber means receiving the centrifugal rotor means, passage means for the cleansed liquid stream from the interior of the rotor, passage means for the first fluid stream of drilling mud into the chamber radially outward from the axis of rotation of the rotor, and the passage means for discharging the exhaust liquid containing solids from the drilling mud begins in the chamber.

4. The downhole cleaner assembly claimed in claim 3 wherein the means for doing useful work includes nozzle means for discharging cleansed liquid stream liquid into the drilling zone for the erosive drilling of rock.

5. The downhole cleaner assembly claimed in claim 2 wherein the drive means includes turbine means in the housing and passage means for providing power fluid to the turbine for driving it.

6. The downhole cleaner assembly claimed in claim 5 including passage means for a portion only of the cleansed liquid stream to supply the turbine means with cleansed liquid as the turbine means power fluid.

7. The downhole cleaner assembly claimed in claim 6 wherein the means for doing useful work includes nozzle means for discharging cleansed liquid stream liquid into the drilling zone for the erosive drilling of rock.

8. The downhole cleaner claimed in claim 3 wherein the drive means includes turbine means in the housing and passage means from the cleansed liquid stream to supply the turbine means with cleansed liquid as the turbine means power fluid.

9. The downhole cleaner claimed in claim 7 wherein the turbine means exhaust into the drilling zone.

10. The downhole cleaner claimed in claim 9 wherein the passage means for the stream of liquid containing solids begins in the chamber radially outward from the axis of rotation and the rotor wall.

11. The downhole cleaner claimed in claim 6 wherein the turbine means exhaust into the drilling zone.

12. A downhole cleaner assembly for a petroleum well comprising:

(a) an elongated housing adapted for receipt in a bore hole of the petroleum well at the base of a drill string;

(b) means for delivering drilling mud to the interior of the housing;

(c) passage means in the housing dividing the drilling mud into a first fluid stream and a second fluid stream, the second fluid stream being delivered to a drilling zone at the base of the bore hole;

(d) cleaner means in the housing for at least partly removing solids from the first fluid stream of the drilling mud and forming a cleansed liquid stream and an exhaust liquid stream containing solids from the drilling mud;

(e) drive means in the housing to drive the cleaner means;

(f) passage means to discharge the exhaust liquid stream of liquid containing solids from the drilling mud into an annulus between the housing and the wall of the bore hole to combine with drilling mud there that passed from the drilling zone;

(g) passage means for the cleansed liquid stream from the cleaner means; and (h) means for drilling rock in the drilling zone with the stream of cleansed liquid from the cleansed liquid passage means.

13. The downhole cleaner assembly for a petroleum well claimed in claim 12 wherein the cleaner means includes at least two axially aligned centrifugal cleaners in the housing, the passage means providing the first fluid stream in parallel branches to the cleaner means.

14. The downhole cleaner assembly claimed in claim 13 wherein the drive means includes turbine means in the housing and turbine inlet passage means for providing power fluid to the turbine and driving it.

15. The downhole cleaner assembly claimed in claim 14 including passage means for a portion only of the cleansed liquid stream as the turbine inlet passage means.

16. The downhole cleaner assembly claimed in claim 15 wherein each centrifugal cleaner means includes:

(a) a centrifugal rotor in a chamber of the housing having an axis of rotation parallel to the longitudinal axis of the housing, an axially extending wall of the rotor, a hollow interior of the rotor, and a plurality of ports through the rotor wall from the chamber into the hollow interior of the rotor;

(b) the passage means for the first fluid stream for the drilling mud emptying into the chamber radially outward of the rotor;

(c) the passage means for the cleansed liquid stream beginning within the hollow interior of the rotor; and (d) the passage means for the exhaust liquid stream of liquid containing solids beginning in the chamber radially outward of the rotor.

17. The downhole cleaner assembly claimed in claim 16 wherein the turbine means exhausts into the drilling zone.

18. A method for cleaning drilling mud downhole in a petroleum well and doing useful work with a cleansed stream generated by the cleaning comprising the steps of:

delivering drilling mud containing liquid and solid materials down a conduit in a well bore;

separating at least a portion of the liquid and solid materials in the well bore into a first cleansed liquid stream having relatively low concentration of solid materials and a second liquid stream having a relatively high concentration of solid materials;

working with at least a portion of the first liquid; and combining the first and second liquid streams in the bore hole annulus surrounding the conduit.

19. The method claimed in claim 18 wherein the working step comprises directing the first liquid stream worked against rock to be drilled.

20. A method for performing work in a well bore comprising the steps of:

delivering drilling mud containing liquid and solid materials down a conduit in a well bore;

separating at least a portion of the liquid and solid materials in the well bore into a first cleansed liquid stream having relatively low concentration of solid materials and a second liquid stream having a relatively high concentration of solid materials;

using at least a portion of the first cleansed liquid stream as power fluid for downhole equipment in the well bore; and combining the first and second liquid streams in the bore hole annulus surrounding the conduit.

21. A method as recited in claim 20 wherein at least a portion of the first cleansed liquid stream drives a pump.

22. A method as recited in claim 20 wherein at least a portion of the first cleansed liquid stream drives a turbine.

* * * * *